United States Patent [19]

McMullan

[11] 4,190,916

[45] Mar. 4, 1980

[54] BASSINET

[76] Inventor: James P. McMullan, 2630 Seaman Ave., El Monte, Calif. 91753

[21] Appl. No.: 954,405

[22] Filed: Oct. 25, 1978

[51] Int. Cl.[2] ..... A47C 27/08

[52] U.S. Cl. ..... 5/451; 5/422; 5/401

[58] Field of Search ..... 5/365, 366, 367, 370, 5/371

[56] References Cited

U.S. PATENT DOCUMENTS

| | | | |
|---|---|---|---|
| 3,746,835 | 7/1973 | Yu et al. | 5/422 |
| 3,789,442 | 2/1974 | Tobinick | 5/450 |
| 4,015,299 | 4/1977 | Tinnel | 5/451 |
| 4,066,072 | 1/1978 | Cummins | 5/422 |
| 4,107,799 | 8/1978 | Lamb et al. | 5/411 |

*Primary Examiner*—Casmir A. Nunberg
*Attorney, Agent, or Firm*—Georges A. Maxwell

[57] ABSTRACT

A water bed structure comprising a flat horizontal mattress including a bladder having vertically spaced horizontal top and bottom walls and vertical side walls of flexible water impervious sheeting and a volume of water within and filling the bladder, a flat horizontal pad of resilient reticulate material within the mattress and the water therein and positioned on the bottom wall and having a top surface normally spaced below the top wall, a retainer unit comprising a flat horizontal panel below and in supporting engagement with said bottom wall and a tubular frame about the panel with a portion projecting upwardly therefrom and cooperating therewith to define a basin in which the mattress is positioned; said frame has a vertical inside wall opposing and supporting the side walls of the mattress, said inside wall having openings communicating with the basin and the interior of the frame whereby water leaked or spilled from the mattress into the basin flows from the basin into the frame.

12 Claims, 5 Drawing Figures

BASSINET

This invention has to do with a water bed structure and is more particularly concerned with a novel bassinet water mattress.

Recent studies have been made and experiments have been conducted to determine the effects different forms of bed structures have on infants. The findings of the studies and experiments established or strongly indicate that in the case of newborn infants, particularly those infants whose births are premature, hard and firm beds are undesirable and that the most desirable form of bed consists of a water filled bladder or that form of bed which is commonly referred to as a water bed.

Prior to birth, a fetus' environment is a yielding fluid environment and is such that there is little unyielding supportive structure which is likely to cause yielding and deformation of the fetus' bone structure or the concentration of forces on the fetus which are apt or likely to interfere with its normal body functions. Still further, the prenatal environment is such that fetuses, upon flexing or moving their muscles, find little firm or rigid structure upon which to press and work. As a result of the above, the exercise fetuses get is subject to yielding resistance and is extended or reaching in nature. That is, when exercising, fetuses stretch and reach to a great extent. Such exercise is quite strenuous and is believed to be extremely important for proper and desirable muscular and bone development.

It has been observed that when newborn infants are laid upon hard, firm bed structures, their soft bone structures are subject to yielding against the supporting bed structures. It is not infrequent that when a prematurely born infant is laid on such a bed structure, the portion of its skull engaging and resting on the bed will flatten visibly. It is believed by many and there are strong indications that such deformation of an infant's skull can bring about serious neurological effects.

In the case of water beds, the beds readily yield and conform to the infant's body and the likelihood of deformation of their bone structure is eliminated or reduced to a negligible extent.

It has been found that when newborn infants are placed upon and supported by hard firm bed structures, upon flexing their muscles, the bed structures afford immediate resistance to initial body movement. As a result, the infants find immediate resistance to exercise and can fail to engage in those extended stretching or reaching exercises which are required or most effective and most desirable for proper muscular and bone development.

In the case of prematurely born infants, with minimal strength, the resistance to movement afforded by hard, firm bed structures is often such that they cannot or will not move. This condition can result in the slowing or stopping of muscular development of the infants, and other adverse effects.

In the case of water beds, such beds are sufficiently fluid and yielding that they closely simulate the prenatal environment of newborn infants and induce the infants to reach and stretch for reaction to their muscular flexing. Accordingly, such beds induce infants to engage in that form of vigorous extending or reaching exercise which is necessary for desired physical development.

The principal shortcoming to be found in the provision and use of water bed structures in bassinets for infants, resides in the fact that newborn infants are so weak and so unconditioned to their new environment that they can drown in water less than an inch deep. To be effective, a water bed mattress for an infant must be about two inches thick (or deep) and must be supported at its bottom and contained about its sides. If such a mattress was to rupture or leak, an infant lying thereon would likely be lying in water two to three inches deep and, depending upon the disposition of its head, would be subject to suffocating or drowning.

The above shortcoming has been determined to be of such magnitude that the use of such water bed structures in bassinets has been determined to present an unreasonable risk of harm and has been rejected (except in cases where the infant is continually attended).

Another serious shortcoming to be found in the use of water bed structures for infants resides in the heating of such beds.

Due to relatively large volumes of water in such beds, they become large heat sinks and/or heat storing means. If such beds are cold or inadequately heated at the time of placing an infant thereon, they can absorb excess body heat from the infant and chill the infant. Such chilling of an infant is likely to bring about a number of different and serious adverse effects.

It is common practice to heat water beds by placing a blanket type resistance heater between the bottoms of the mattresses and their supporting structure. Such heater means commonly include thermostatic control means responsive to the temperatures of the mattresses and which are reasonably effective to establish and maintain the temperature of the mattresses at desired predetermined temperature.

While the above noted heating means and temperature control means are suitable for large conventional water beds, they do not lend themselves to satisfactory use in connection with small water bed mattresses such as would be required for use in bassinets.

In the case of full size water beds, if the mattress should leak or rupture and a grown or fully matured person lying on it was lowered so that he was to rest directly atop a resistance heater beneath the mattress, with only the walls of the mattress between his body and the heater, his developed and mature senses would alert him to the rapid and great increase of heat on his body which would result in such a situation and he would and could extract himself to avoid bodily harm. In the same situation, but with an infant having undeveloped senses and/or insufficient strength to extract itself from a dangerous situation, it is likely that the infant would not respond to increases in heat, could not and would not extract itself from this dangerous situation and would be seriously, if not fatally, heated and/or burned.

As a result of the foregoing, the regular use of water bed mattresses with heating means in bassinets has been determined to create such a high risk of harm that their use is most often prohibited.

Yet another shortcoming in water bed structures of the character referred to above which is considered to make their use in bassinets risky and inadvisable is the likelihood that the electric resistance heater means which are required for their effective use will short out and electrocute infants lying thereon, should the mattresses leak or rupture.

An object of the present invention is to provide a novel bassinet water bed structure including a water filled mattress and related water receiving means to receive and hold water leaked or spilled from the mattress so that in the event the mattress leaks or ruptures, insufficient free water can collect and occur at the top surface of the mattress to present a risk of harm to an infant lying thereon.

It is another object and feature of my invention to provide a water bed structure of the character referred to which includes a central bladder like mattress with flexible top, bottom and side walls defining a water holding chamber and a tubular frame about the perimeter of and confining the mattress and having laterally inwardly disposed openings through which water at the exterior and above the mattress and inward of the frame can drain into and collect within the frame.

Still another object and feature of my invention is to provide a water bed structure of the character set forth above wherein said tubular frame structure is established of flexible plastic film and has a supporting water receiving core of resilient reticulated or open cellular material.

Another object of my invention is to provide a bed structure of the character referred to above wherein the mattress has a flat soft resilient support pad of inter-connected cellular foam plastic overlying the bottom wall thereof to normally occur in spaced relationship beneath the top wall so its top surface is on substantially the same plane as the water level in the tubular frame when the water in the mattress has leaked or spilled therefrom and flowed into the frame.

It is an object of my invention to provide a bed structure of the character referred to above wherein the soft resilient pad within the mattress serves to provide a soft resilient support for an infant lying on the mattress when the water in the mattress has spilled or leaked therefrom and the mattress collapses, and, which provides a heat insulating barrier between the top and bottom walls of the mattress to prevent direct conduction of heat through the mattress structure between an infant on the top of the mattress and a heater below the mattress, should the mattress collapse.

Still another object of my invention is to provide novel heating means for the above noted bed structure, which means includes a flat heat conducting plate engaged below and supporting the mattress, an electric resistance heater engaging and heating the plate and temperature control means responsive to the temperature of the plate and controlling operation of the heater.

It is another object and feature of my invention to provide a structure of the character referred to above wherein said plate is grounded and said heater and temperature control means are related to the underside of the plate, remote from the mattress supported thereon.

An object and feature of my invention is to provide a structure of the character referred to above wherein said plate defines the top of a case defining a closed compartment in which the heater and temperature control means are arranged.

The foregoing and other objects and features of the present invention will be fully understood and will be apparent from the following detailed description of a preferred form and carrying out of my invention throughout which description reference is made to the accompanying drawings in which.

Figure 1:
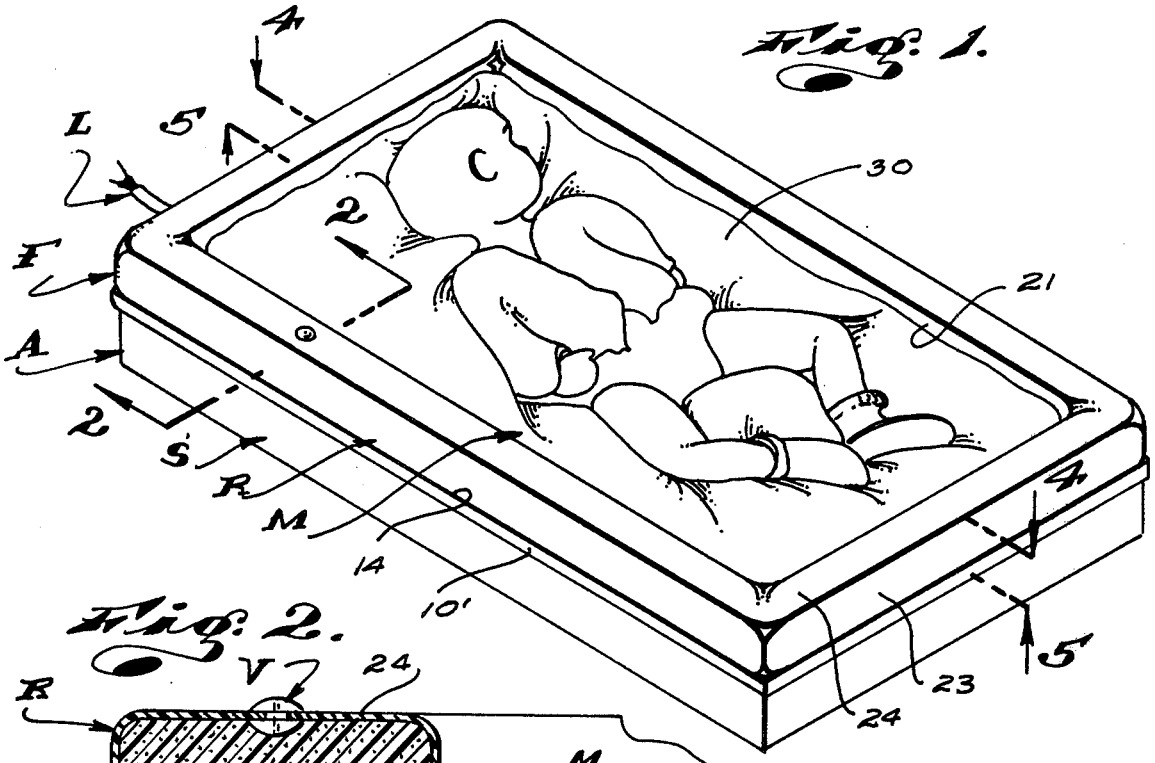
FIG. 1 is an isometric view of a bassinet embodying the invention.
Figure 2:
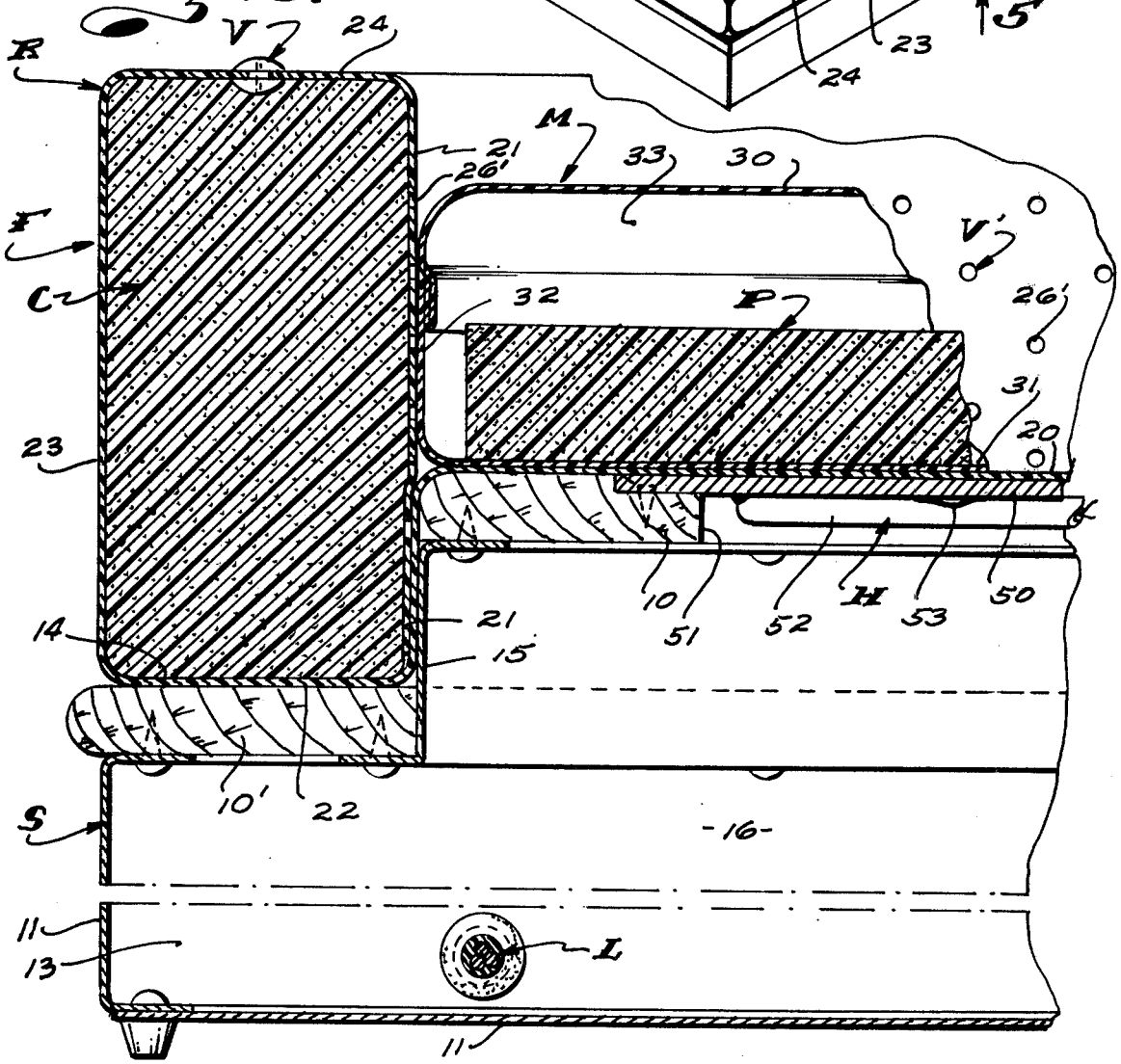
FIG. 2 is an enlarged detailed sectional view taken as indicated by line 2—2 on FIG. 1.

In the drawings, I have shown a preferred form of crib or bassinet water bed structure A embodying my invention. The proportioning and/or dimensions of the structure A are substantially the same as a standard crib or bassinet mattress and is such that the structure A can be substituted for a standard or conventional crib or bassinet mattress in a standard crib or bassinet frame structure.

The bed structure A includes a support S, a retaining unit R above and carried by the support S and a mattress M above and supported by the structure S and retained by the unit R.

The box-like support S is shown as being rectangular in plan configuration, with flat horizontal top and bottom walls 10 and 11 and vertical side and end walls 12 and 13.

In practice, the top wall 10 is established of particle board or the like and the side and bottom walls are preferably established of sheet metal.

In the form of the invention illustrated, the outer perimeter portion 10' of the top wall is separate from the inner portion of that wall and is lowered to occur on a plane spaced below the plane of the inner portion of the wall. The outer portion 10' defines a flat upwardly disposed, lower supporting shelf 14 about the perimeter of the support structure.

The shelf defining outer portion 10' of the top wall 10 is secured to the inner portion 10 of that wall by the sheet metal, frame-like insert 15 substantially as shown in the drawings.

The sheet metal side, end and bottom walls 12, 13 and 11 of the structure S are suitably formed, assembled and secured together and are related with the top wall structure to define an open space or chamber 16, beneath the top wall.

The retaining unit R is established of flexible plastic sheet or film stock and includes a flat horizontal central bottom panel 20 corresponding in plan configuration with and normally arranged in flat overlying, supported, engagement on the central portion of the top wall 10. The unit R has a tubular frame portion or frame about its perimeter. The frame F is rectangular in cross-section and is established by a suitably formed extension of sheet or film stock about the perimeter of the panel 20.

The frame F has a vertical inner wall 21 with a lower portion depending from the outer edge of the panel 20, an outwardly projecting horizontal bottom wall 22, about the lower edge of the inner wall, a vertical outer wall 23 projecting up from above the outer edge of the bottom wall, a horizontal top wall 24 projecting inwardly from the top of the outer wall, and joined with the upper portion of the inner wall, which upper portion of the inner wall depends from said top wall to join the panel 20 and/or the lower portion of the inner wall.

The lower edge portion of the upper portion of the inner wall 21 of the frame depends to occur adjacent or in lopped engagement with the lower portion of the inner wall. In practice, if desired, the adjacent or lopped portions of the inner wall can be releasably secured thereto by a plurality of snap fastening devices (not shown) suitably spaced about the perimeter of the inner wall.

The frame F is provided with a soft resilient core C of resilient reticulated or inter-connected cellular material which is rectangular or the same in cross-section as the interior of the frame and which normally yieldingly maintains the frame in proper configuration.

The lower portion of the frame F occurring below the plane of the panel 20 depends about the inner portion of the top wall 10 with its lower wall 22 seated on and supported by the lower shelf 14 of the support structure S.

The upper portion of the tubular frame F occurring above the plane of the panel 20 surrounds and cooperates with the panel 20 to define a catch basin. The lapped seam or line of joinder between the upper and lower portions of the inner wall 21, occurring about and extending down from the panel 20, establishes an unsealed passage 26 establishing communication between the interior of the frame and the basin, at and about the bottom of the basin. Accordingly, water in the basin is substantially free to drain outwardly through the passage 26 and into the tubular frame.

In practice, the upper and lower portions of the inner wall 21 of the frame can be fixed together as by welding or the like, without departing from the spirit of the invention. However, utilizing the noted lapped seam, snap fasteners or equivalent releasable fastening means is preferred since such means allows for convenient opening of the frame and removal of the core C therefrom for the purpose of cleaning and sterilizing the construction.

Finally, the retaining unit R is provided with air vent means V at the top of the frame F so that when water in the basin flows through the passage 26 and into the frame, air displaced by the water is free to vent through and out of the top of the frame.

The reticulated or inter-connected cellular core C within the frame is such that it establishes and normally maintains the frame in desired configuration and yet allows for the free flow of water into and out of the frame as circumstances require.

It will be apparent that the frame F, with its soft core C provides a soft cushion like structure which an infant can engage without the likelihood of being bruised or injured.

The mattress M of the structure A is a substantially flat horizontal bladder having top, bottom, side and end walls 30, 31, 32 and 33. The mattress M is established of soft flexible plastic film or sheet stock or plasticized fabric. In practice, the bladder like mattress is established by two (upper and lower) suitably shaped sheets of plastic, welded together about their adjacent, related edges and such that when the bladder structure is arranged within the frame F and is filled with water, the several noted walls thereof are defined and distinguishable.

In addition to the above, the mattress M has a filler fitting (not shown) in, for example, a side wall thereof to facilitate filling the mattress with water. The fitting is preferably that standard or common form of sealable filler tube type of fitting used in various forms of inflatable plastic structures and which is well known in the art.

Finally, the mattress M includes a soft, resilient pad P of reticulated or inter-connected cellular foam material arranged within the bladder to rest upon and overlie the bottom wall 31 thereof.

The mattress M, when filled with water and when arranged within the frame F of the retaining unit R, with its bottom wall 31 in flat bearing, supported engagement with the panel 20 of the unit R and with its sides and ends in bearing conforming and retained engagement within the inner wall 21 of the frame F, is such that its top wall 30 is on a plane which can be parallel with, but which is preferably substantially below the top wall 24 of the frame F.

The top surface of the flat horizontal pad P in the mattress M is normally spaced below the top wall 30 of the mattress a sufficient distance so that when an infant is engaged on the top wall 30 and its weight depresses the top wall, the top wall does not engage and bear on the top of the pad P.

Figure 3:
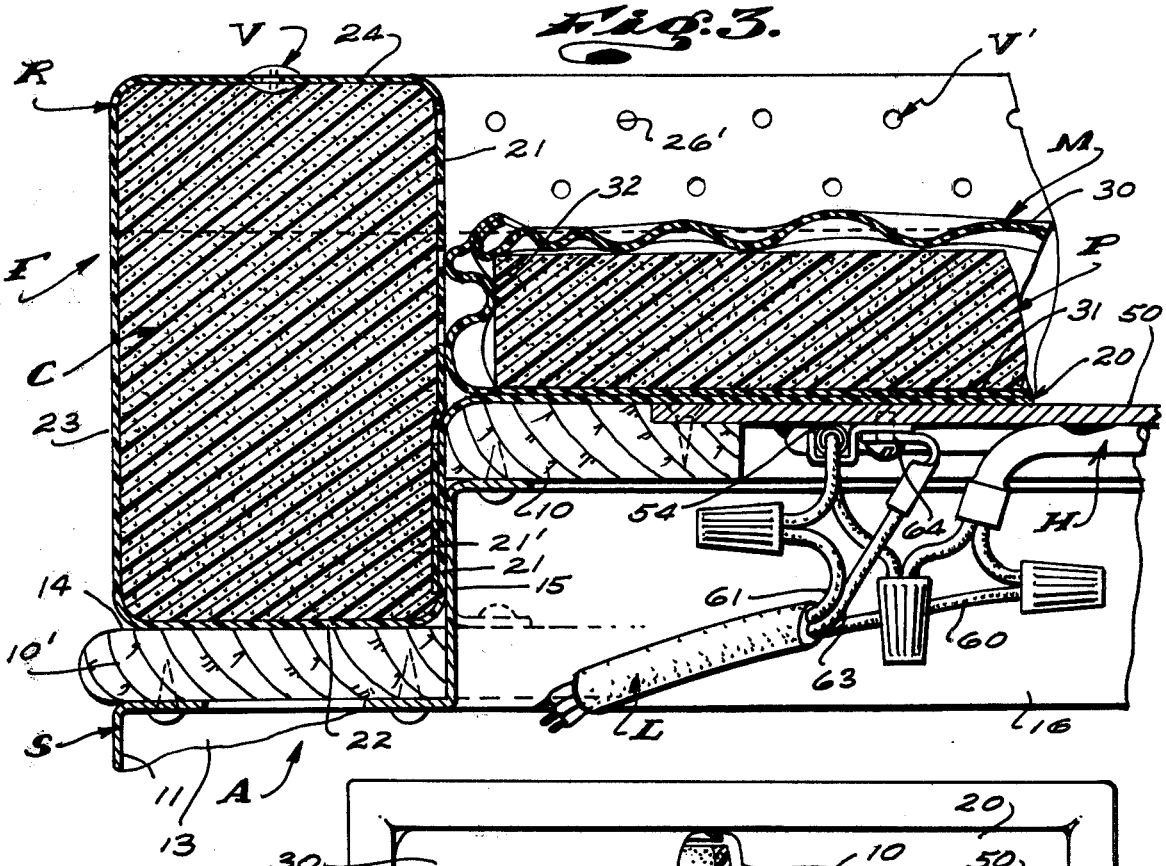
FIG. 3 is a view similar to FIG. 2 showing parts in another position.
Figure 4:
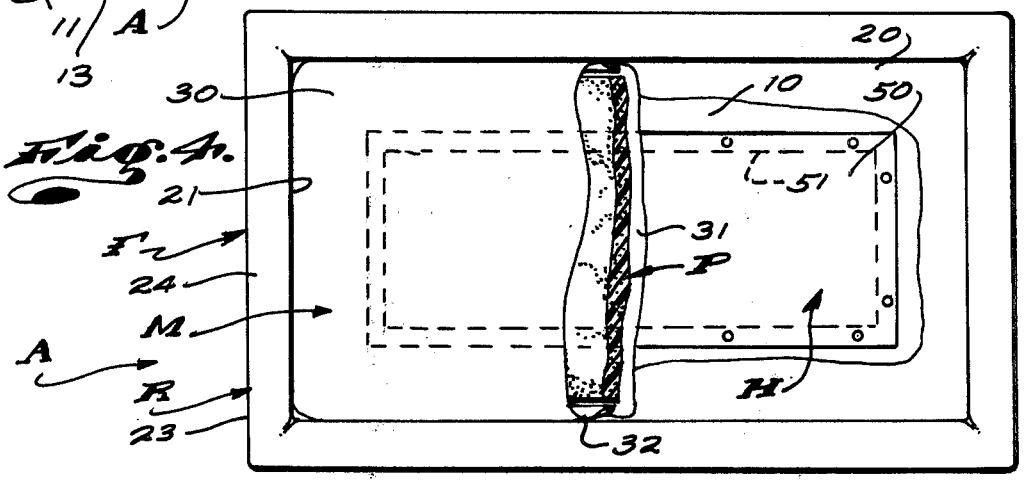
FIG. 4 is a view taken as indicated by line 4-K on FIG. 1.
Figure 5:
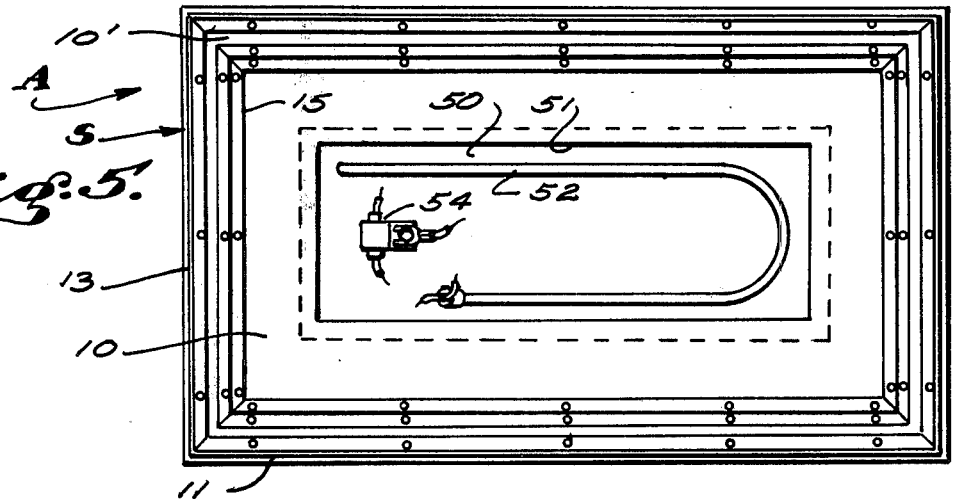
FIG. 5 is a view taken as indicated by line 5—5 on FIG. 1.

The volume of the bladder-like mattress M, less the effective volume of the fluid holding pad P is equal to the fluid level within the frame F, up to a water level within the frame F which is on substantially the same horizontal plane as the top of the pad P. With this relationship and relative proportioning of parts or means, it is apparent or will be seen that should the mattress M leak or spill the water normally contained thereby, the leaked or spilled water within the basin defined by the unit R will flow freely into the frame F. When the bladder collapses to an extent that its top wall 30 engages and is stopped by the top of the pad P, no appreciable amount of free standing water will occur at and above the top surface of the deflated mattress and within the basin. All free water, which might otherwise create a risk of harm to an infant on the top of the mattress will be safely drained away and collected within the frame F, as clearly shown in FIG. 3 of the drawings.

In practice, and as shown in the drawings, the frame F of the unit R can be and is preferably provided with secondary drain and vent means V'. The means V' comprises a multiplicity of openings or apertures 26' spaced throughout the upper portion of the basin defining inside wall 21 of the frame F. The openings 26' of the means V' assures free and rapid drainage of water from the basin into the frame F and free and rapid outward flow of water displaced air from within the frame. The means V' prevents the possibility of the mattress M engaging and sealing with the wall 21 in such a manner that would prevent water from flowing out of the basin and into the frame through the passage 26'. The openings 26' also assure desired drainage from the basin into the frame, should the lapped portions of the inner wall 21 establish sealed relationship with each other or unduly restrict and slow such drainage.

In addition to the foregoing, the means V' also serves to vent the interior of the frame so that conditions within the frame which might result in the rapid growth of bacteria, fungi and the like, cannot develop.

It is to be understood that in practice, the retaining unit R can vary widely in details of construction and in relative proportioning and dispositioning of its parts and portions, without departing from the spirit of this invention. Further, the support structures for the unit R and the mattress M can be changed and vary widely in details of construction to accommodate changes that might be made in the unit R, changes in materials employed and the like without departing from the broader aspects of the invention.

In furtherance of my invention, I provide heating means H to heat and to normally maintain the mattress M at a predetermined desired temperature.

The heating means H includes a flat, horizontal metal heating plate 50 overlying and closing an opening 51 located substantially centrally in the top wall 10 of the support structure S. The plate 50 is preferably established of alluminum and is of heavy gauge so as to assure its having uniform heat conducting characteristics. The plate 50 is suitably set in and fixed to the wall 10 with its top surface flush with the top surface of the wall 10, as clearly illustrated in the drawings.

The means H next includes an elongate jacketed electric resistance heater 52 arranged in direct heat conducting contact with the bottom surface of the plate 50. The heater can be releasably secured to the plate by screw fastening means or can, as illustrated, be fixed thereto as by cement or as by welds as indicated at 53.

The means H next includes a normally closed preset or adjustable, solid state, thermo-responsive switching device 54 fixed to the bottom surface of the plate 50 in spaced relationship from the heater 52. The switching device 54 is responsive to the temperature of the plate 50 and closes when the temperature of the plate 50 drops to or below a predetermined set or adjusted operating temperature.

In practice, the device 54 can be replaced by a thermal bulb or capillary tube type of temperature responsive units related to a mechanically operated switch, remote from the plate 50, without departing from the spirit of the invention.

The means H includes a three line ground-type power service cable L extending from a suitable power source (not shown) remote from the structure A. The cable enters the support structure S through an opening in a side or end wall thereof and extends through the chamber 16 toward the plate 50, heater 52 and switching device 54. The pair of power lines or conductors 60 and 61 of the cable are connected with the heater 52. The switching device 54 is interposed in and connected with the conductor line 61. The ground line 63 of the cable is suitably secured and electrically connected with the plate 50, as by means of a terminal fitting and screw fastener assembly 64.

It will be apparent that the plate 50 which opposes and supports a substantial area of the bottom wall of the mattress M with only the thin panel P of the unit R between them, is such that it will effectively distribute and conduct heat into the mattress throughout a large surface area thereof, when circumstances require and will, when required, absorb heat from the mattress throughout the same large surface thereof.

The heater 52 on the plate 50, when energized, delivers heat into the plate 50 which heat is conducted directly throughout the mass and area of the plate for delivery into the portion of the mattress M which is related to it.

The switching device 54 is spaced from the heater 52 a sufficient distance so that when the heater is energized and heat is delivered to the plate, the greater part of that heat is delivered by the plate into the mattress before it can be conducted through the plate to heat that portion of the plate adjacent the switching device. As a result of the above, the temperature of the portion of the plate adjacent the switching device is normally substantially the same as the temperature of the mattress M and its temperature is not materially and directly altered by the heat delivered into the plate by the heater 52 unless or until the heater delivered heat into the plate at a greater rate than the mattress can absorb heat. Accordingly, the thermo-responsive switching device can be and preferably is spaced from the heater 52 to establish a substantially balanced condition wherein the temperature of the plate adjacent the switching device is essentially the same as the temperature of the mattress until such time as the temperature of the mattress reaches the desired mattress temperature and operating temperature of the device, at which time the rate at which the mattress can absorb the heat is lowered to an extent that excess heat is delivered to the plate by the heater 52. The excess heat is conducted to and elevates the temperature of the plate adjacent the switching device and causes it to open.

Having described one typical preferred form and application of my invention, I do not wish to be limited to the specific details herein set forth, but wish to reserve to myself any modifications and/or variations that may fall within the scope of the following claims:

Having described our invention, we claim:

1. A water bed structure comprising a flat horizontal mattress including a bladder having vertically spaced horizontal top and bottom walls and vertical side walls of flexible water impervious sheeting and a volume of water within and filling the bladder, a flat horizontal pad of resilient reticulate material within the mattress and the water therein and positioned on the bottom wall and having a top surface normally spaced below the top wall, a retainer unit comprising a flat horizontal panel below and in supporting engagement with said bottom wall and a tubular frame about the panel with a portion projecting upwardly therefrom and cooperating therewith to define a basin in which the mattress is positioned; said frame has a vertical inside wall opposing and supporting the side walls of the mattress, said inside wall having openings communicating with the basin and the interior of the frame whereby water leaked or spilled from the mattress into the basin flows from the basin into the frame.

2. The water bed structure set forth in claim 1 wherein the volumetric capacity of the frame and of the mattress and the relative positioning of the frame and the mattress are such that when water flows out of the mattress and flows into the frame, the water level in the mattress and in the frame establish equilibrium on a plane below the top surface of said pad.

3. The water bed structure set forth in claim 2 wherein the retaining unit is established of soft, flexible water impervious sheet material and said tubular frame has a core of soft, resilient reticulate material into which water entering the frame can freely flow.

4. The water bed structure set forth in claim 1 wherein the retaining unit is established of soft, flexible water impervious sheet material and said tubular frame has a core of soft, resilient interconnected reticulate material into which water entering the frame can freely flow.

5. The water bed structure set forth in claim 1 which further includes heating means to heat the mattress; said heating means includes a flat, horizontal heat conducting metal plate below said panel and having a top surface in heat conducting contact with said panel, an electric resistance heater below and secured in heat conducting contact with the bottom surface of the plate, a normally closed temperature responsive switching device below the plate and responsive to the temperature of the plate at a location spaced from the heater and an electric power supply connected with the heater and said device whereby the heater is energized when the temperature of the plate adjacent the device is below a predetermined temperature.

6. The water bed structure set forth in claim 5 wherein the volumetric capacity of the frame and of the mattress and the relative positioning of the frame and the mattress are such that when water flows out of the mattress and flows into the frame, the water level in the mattress and in the frame establish equilibrium on a plane substantially common with the top surface of said pad.

7. The water bed structure set forth in claim 6 wherein the retaining unit is established of soft, flexible water impervious sheet material and said tubular frame has a core of soft, resilient reticulate material into which water entering the frame can freely flow.

8. The water bed structure set forth in claim 5 wherein the retaining unit is established of soft, flexible water impervious sheet material and said tubular frame has a core of soft, resilient material into which water entering the frame can freely flow.

9. The water bed structure set forth in claim 5 wherein said plate is positioned in an opening and is carried by a horizontal top wall of a mattress and retaining support structure which is positioned below the retaining unit in supporting engagement therewith.

10. The water bed structure set forth in claim 9 wherein the volumetric capacity of the frame and of the mattress and the relative positioning of the frame and the mattress are such that when water flows out of the mattress and flows into the frame, the water level in the mattress and in the frame establish equilibrium on a plane substantially common with the top surface of said pad.

11. The water bed structure set forth in claim 10 wherein the retaining unit is established of soft, flexible water impervious sheet material and said tubular frame has a core of soft, resilient reticulated material into which water entering the frame can freely flow.

12. The water bed structure set forth in claim 9 wherein the retaining unit is established of soft, flexible water impervious sheet material and said tubular frame has a core of soft, resilient reticulate material into which water entering the frame can freely flow.

* * * * *